United States Patent [19]

Hoes et al.

[11] 4,043,135

[45] Aug. 23, 1977

[54] TRENCH CUTTER FOR EXCAVATING TRENCHES AND FOR LAYING WATER PIPES AND DRAINAGE PIPES

[75] Inventors: Klaus Gerd Hoes, Oberlethe; Gerold Wöbken, Elsfleth, both of Germany

[73] Assignee: Firma Klaus-Gerd Hoes, Oldenburg, Germany

[21] Appl. No.: 692,252

[22] Filed: June 3, 1976

[30] Foreign Application Priority Data

Nov. 12, 1975 Germany ..... 2550735

[51] Int. Cl.[2] ..... E02F 5/10; E02F 5/22

[52] U.S. Cl. ..... 61/72.5; 37/86

[58] Field of Search ..... 61/72.5, 72.4, 72.6, 61/41, 84, 85, 42, 104; 214/1 PA, 1 CM, 1 P; 172/40; 37/86, 94

[56] References Cited

U.S. PATENT DOCUMENTS

| | | | |
|---|---|---|---|
| 2,815,726 | 12/1957 | Davenport | 61/72.5 |
| 3,421,609 | 1/1969 | Schmunk | 61/72.5 |
| 3,605,419 | 9/1971 | Wells | 61/72.5 |
| 3,956,901 | 5/1976 | Brown | 61/72.5 |

*Primary Examiner*—Dennis L. Taylor
*Attorney, Agent, or Firm*—Allison C. Collard

[57] ABSTRACT

A trench cutter for excavating trenches and for laying water pipes and drainage pipes into trenches consisting of a travelling cutter chain with a jib supporting the cutter chain, the jib being pivotable in a vertical plane. A pipe laying duct is included for entering the excavation and sliding on the bottom of the excavation trench, the laying duct being pivotably connected to the jib. A duct guide arm extends parallel to the back surface of the pipe laying duct for supporting the duct vertically so that it faces the cutter chain. A plurality of parallel guide rollers have one end pivotably connected to the duct guide arm and their opposite end connected to the outward drive shaft of the trench cutter. The drive shaft of the trench cutter is pivotably connected to the free end of the jib. Guide rod linkages are connected to at least one work cylinder in order to adjust the angle of inclination between the cutter chain and the duct to change the clearance between the duct and the chain so that the duct can describe a curved path to permit the lower edge of the duct to be substantially tangential to the outer turning radius of the lower cutter chain.

4 Claims, 1 Drawing Figure

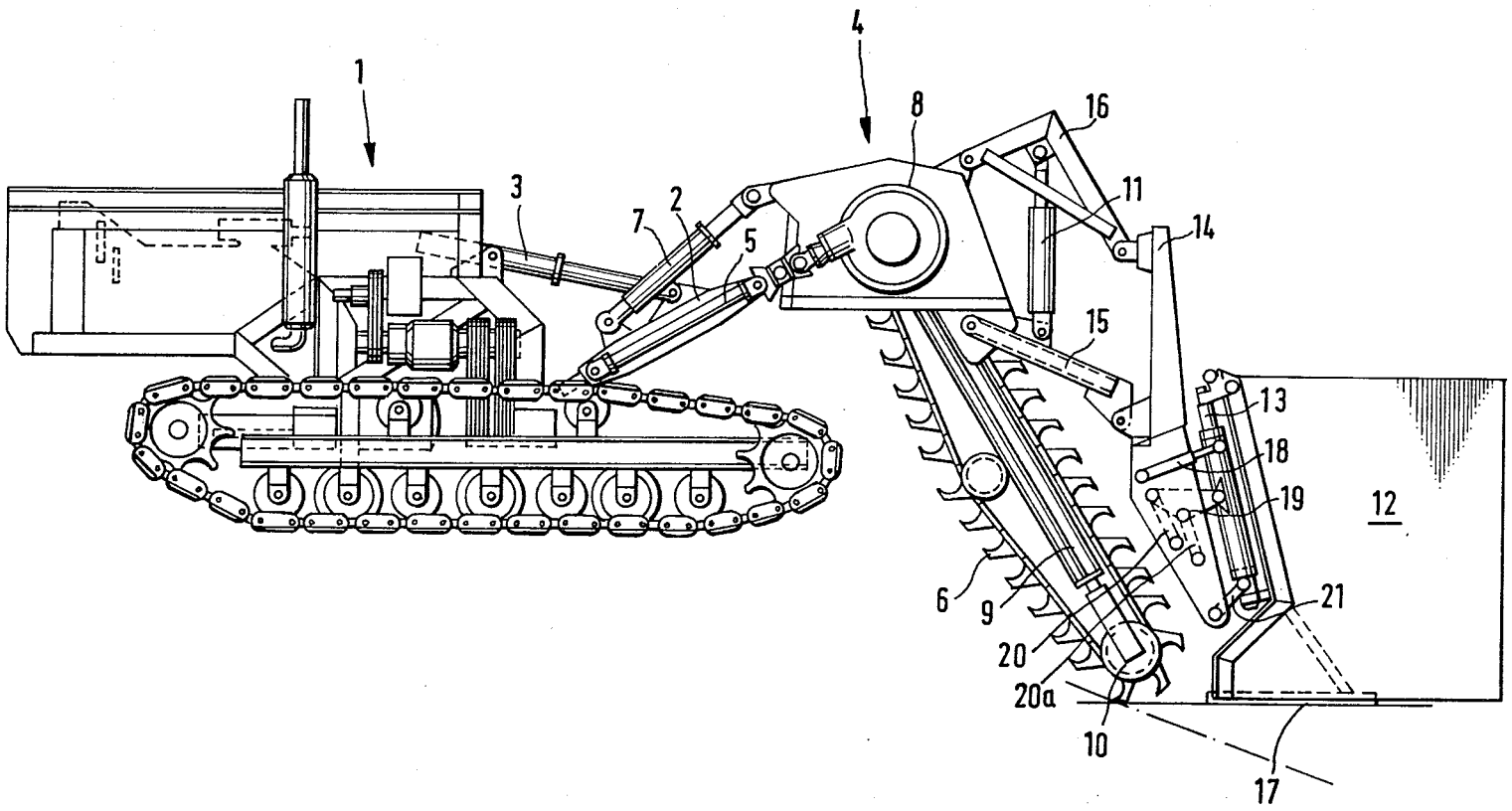
1
2
3
4
5
6
7
8
9
10
11
12
13
14
15
16
17
18
19
20
20a
21

TRENCH CUTTER FOR EXCAVATING TRENCHES AND FOR LAYING WATER PIPES AND DRAINAGE PIPES

The invention relates to a trench cutter for excavating trenches and for laying water pipes and drainage pipes in trenches.

In known drainage machines, the so-called cutter unit is disposed on a job and is adjustable by hydraulic cylinders. Behind this cutter unit which consists substantially of a travelling cutter chain, a laying duct is mounted which slides by its lower duct base on the bottom of the cleared trench during the placing of water pipes and drainage pipes. The duct base, i.e. the lower horizontal part of the laying duct by which it slides on the bottom of the trench, is so orientated relative to the cutter unit that the extended plane of the surface sliding on the bottom of the trench is tangential to the outer diameter of a partialcircle which the cutter blades describe when they run over the lower guide roller of the cutter chain. Since the duct and the cutter are rigidly connected together in the known drainage machines, the cutter apparatus always operates at the same clearance angle to the horizontal if no depth corrections are made for the excavated trench, because the duct base rests snugly on the trench bottom. During trench cutting, the adjustment cylinders for the jib supporting the cutting apparatus and the laying duct are moved into the floating position, i.e. they can move freely. Thus, the cutting and laying unit is supported on the one hand on the trench bottom and, on the other hand, in the centre of the traction machine at the pivot point of the jib.

A change of the excavation depth is obtained in that the laying unit which is rigidly connected to the cutting unit is lifted towards the front or the back at its duct base, that is to say, the angle of the cutting chain and the duct base to the trench bottom changes. Thus, the cutter cuts higher lor lower, namely until the given clearance angle between the cutter chain and the horizontal is attained, i.e. the duct base of the laying duct lies horizontal again.

Since for technical reasons the length of the jib, its clearance angle and thus also the stroke of the jib are limited, a correction of the excavation depth can also be effected only in predetermined limits with the known drainage machines. Thus, e.g. work can be performed only in depths of from 0.7 to 1.8 m. If however a trench is to be cut in shallower depth, the clearance angle of the cutter chain must be changed. Thereby, the degree of efficiency of the cutting machine changes mostly to the negative side, because the clearance angle falls outside a range favorable to the optimum cutting efficiencies. The deterioration of the cutting efficiency can still be tolerated, since such extreme clearance angles are necessary during the cutting of trenches for only short periods of time. The operation in shallower depths and the change of the clearance angle connected therewith must, however, also fulfill the requirement that the lower edge of the duct base is tangential to the outer cutting circle. For this purpose, the duct base should be rotatably mounted in the centre of the guide roller. This, however, is technically impossible because the return run of the cutter chain is disposed between the guide roller and the duct base. Thus it is impossible to perform perfect trench cutting in shallow depths.

According to the present invention, there is provided a trench cutter for excavating trenches and for laying water pipes and drainage pipes into the trenches, with a travelling cutter chain carried by a jib pivotal in a vertical plane. There is a pipe laying duct which is also pivotally connected to the jib and which dips into the trench excavated trench. The laying duct is suspended by its back surface which is disposed approximately vertically and faces the cutter chain from a duct guide arm extending parallel to the back surface by means of a suspension. The duct guide arm is adjustably and pivotally connected by means of parallel guide rockers to drive the housing, which is pivotally connected to the free end of the jib supporting the cutter chain. The suspension is supported at the duct guide arm by way of guide rod linkages which are actuable by at least one work cylinder. The work cylinder adjusts the angle of inclination between the cutter device and the duct and, upon a change of the clearance angle, cause the duct to describe a curved path which causes the lower edge of the duct base to be always substantially tangential to the outer turning radius of the lower cutter chain.

The guide rod linkage is suitable for causing the lower edge of the duct base to be tangential to the outer cutting circle with sufficient accuracy at least in the practical range of use. The necessary change of the clearance angle, in order to be able to cut trenches also in shallow depths, amounts to approximately 20° in the practical range of use. Within the clearance angle range of 20°, any angle can be adjusted in a stepless manner by means of a hydraulic cylinder which is supported between the duct guide arm and the back surface of the duct. The hydraulic cylinder can be actuated from the driving seat of the trench cutter by means of a valve. The pivotal connection of the duct guide arm by means of parallel guide rockers to the drive housing carrying the cutter apparatus permits in an advantageous manner, a separate lifting of the laying duct independently of the guide movement of the jib and the cutting chain itself. Thereby, e.g., the cutter chain itself can be lowered laterally into a prefabricated drain into which the laying duct would not fit under normal circumstances. In this case, the laying duct is raised to such an extent that the base of the laying duct does not come to rest on the freshly excavated trench until a sufficient trench has been excavated transversely to the longitudinal direction of the prefabricated drain.

The guide rod linkage between the suspension on the duct guide arm of the laying duct and the duct guide arm itself is preferably so constructed that it has a connecting rocker, the one end of which is pivotally connected to a connecting pin of the hinge-like duct suspension, and at the other end of which a first displaceable lever arm is mounted, the free end of which is mounted on the duct arm. Between the end points of the connecting rocker, a second displaceable lever arm is pivotally connected, the free end of which is also mounted on the duct guide arm below the pivot connection of the first lever arm. A lower guide rocker is provided which extends between a pivot connection at the lower end of the duct guide arm and a pivot connection in the lower region of of the connecting pin. Above the connecting rocker is disposed the inclination adjusting cylinder, the piston of which engages the laying duct and the cylinder of which is supported on the duct guide arm.

The duct guide arm is preferably constructed as an open profile into which the guide rods for the laying duct can be lowered. Since the suspension of the laying duct is constructed in a releasable manner, a trench can be cut e.g. even without the laying duct.

Other objects and features of the present invention will become apparent from the following detailed description when taken in connection with the accompanying drawing which discloses several embodiments of the invention. It is to be understood that the drawing is designed for the purpose of illustration only, and is not intended as a definition of the limits and scope of the invention disclosed.

The single FIGURE is a diagrammatic side view of a trench cutter according to the invention.

In the FIGURE, the trench cutter consists of a traction machine 1 with chain drive, on which all driving elements are accommodated. A jib 2 which is pivotal in a vertical plane and which can be displaced by means of a hydraulic cylinder 3 is mounted approximately in the center of the traction machine. The free end of the jib carries a cutting device 4 proper, to which the necessary driving energy for a cutter chain 6 is supplied by way of a transmission shaft 5 in the manner of the take-off shaft drive in agricultural tractors and machines. Cutting device 4 is displaceably and pivotally mounted at the head end of jib 2, the displaceability being produced by a further hydraulic cylinder 7. The clearance angle of the cutter chain and the entire cutting unit relative to the horizontal and the ground surface can also be controlled with the hydraulic cylinder. The cutting device consists of the drive housing 8 pivotally and displaceably connected to the end of the jib, and a cutter arm 9 which projects downwardly therefrom. The ends of cutter arm 9 support guide rollers of which only the lower guide roller 10 is of interest. A lifter cylinder 11 for the laying duct 12, associated with the back surface of the cutting device, is supported on the cutting device or the drive housing 8. Laying duct 12 is suspended by means of a hingelike duct connection 13 from a duct guide arm 14 which in turn is pivotally connected to the drive housing 8 of the cutting device by means of a lower parallel guide rocker 15, and an upper parallel guide rocker 16. The piston of lifter cylinder 11 engages the upper parallel guide rocker 16 so that the laying duct can be raised and lowered independently of the movement of the cutting device. The base 17 of the laying duct, however, always remains parallel. When the duct is raised above duct guidance 14 by means of lifter cylinder 11, its clearance angle which is equal to the clearance angle of cutter chain 6 relative to the ground or to the horizontal, is thus not changed.

In order to be able to also operate in shallower trench depths, the base edge 17 of laying duct 12 must always be tangential to the radius if cutter chain 6 around lower guide roller 10 on the extended lines indicated. This is rendered possible by a change of the inclination of the laying duct matched to the change of the clearance angle, with which its base edge 17 is placed into the plane of the dash-dotted line. A tilter cylinder 18 is used for this inclination, the pivotal connection or suspension of laying duct 12 at the lower region of duct guide arm 14 being effected by guide rod linkages which comprise a connection rocker 19 to which two upper guide rockers 20 are pivotally connected which in turn are displaceably connected to the rearward portion of the hollow duct guide arm. The suspension or duct connection 13 is effected at the lower end by means of a displaceable lower guide rocker 21. Upon extension of the tilter cylinder 18, the guide rod linkage with the parts 19, 20 and 21, causes base 17 of laying duct 12 to move in a curved path by so that the extension line of base 17 is always tangential to the radius of the lower guide roller of cutter chain 6.

While only a single embodiment of the present invention has been shown and described, it will be obvious to those skilled in the art that many changes and modifications may be made thereunto without departing from the spirit and scope of the invention.

What is claimed is:

1. A trench cutter for excavating trenches and for laying water pipes and drainage pipes into the trenches, said cutter having an output drive shaft comprising:

a travelling cutter chain for digging an excavation;

a jib supporting said cutter chain, said jib being pivotable in a vertical plane;

a pipe laying duct for entering the excavation, and sliding on the bottom of the excavated trench, said pipe laying duct being pivotably connected to the jib;

a duct guide arm extending parallel to the back surface of said pipe laying duct for supporting the pipe laying duct vertically so that it faces said cutter chain;

a plurality of parallel guide rockers having one end pivotably connected to said duct guide arm, said rockers being connected at their opposite end to said output drive shaft of the trench cutter, the drive shaft being pivotably connected to the free end of said jib; and at least one work cylinder, and guide rod linkages connected thereto for adjusting the angle of inclination between the cutter chain and the duct wherein a change of the clearance between said duct and cutter chain causes said duct to describe a curved path so that the lower edge of said duct is substantially tangential to the outer turning radius of the lower cutter chain.

2. A trench cutter as claimed in claim 1 wherein said duct includes a hinge-like duct connection, for releasably and hingably connecting said duct to said duct guide arm.

3. A trench cutter as claimed in claim 1 wherein said duct guide arm has a partially open profile into which said guide rod linkages for the duct can be lowered.

4. The trench cutter as claimed in claim 3 wherein said guide rod linkage has a connecting rocker, one end of which is pivotally connected to a connecting pin of said hinge-like duct connection and the other end of which carries a first upper guide rocker constructed as a movable lever arm, the free end of which is mounted on said duct guide arm, a second upper guide rocker constructed as a movable lever arm and pivotally connected between the end points of said connecting rocker, the free end of said second rocker being mounted on said duct guide arm below the pivotal connection of said first guide rocker, a lower guide rocker extending between a pivotal connection at the lower end of said duct guide arm and a pivotal connection in the lower region of the connecting pin of said duct connection, and above said connecting rocker, the inclination adjusting cylinder is disposed, the piston of which engages said laying duct and the cylinder of which is supported on said duct guide arm.

* * * * *